US005128844A

United States Patent [19]

Landais

[11] Patent Number: 5,128,844

[45] Date of Patent: Jul. 7, 1992

[54] SIGNAL HELMET APPARATUS

[76] Inventor: Andrè M. Landais, 3033 Coney Island Ave., Brooklyn, N.Y. 11235

[21] Appl. No.: 751,135

[22] Filed: Aug. 28, 1991

[51] Int. Cl.[5] ..... F21L 15/14

[52] U.S. Cl. ..... 362/105; 362/96; 362/106; 362/806

[58] Field of Search ..... 362/96, 103, 105, 106, 362/806, 811

[56] References Cited

U.S. PATENT DOCUMENTS

| | | | |
|---|---|---|---|
| 3,963,917 | 6/1976 | Romano | 362/106 |
| 4,796,166 | 1/1989 | Greenberg | 367/96 |
| 4,945,458 | 7/1990 | Batts et al. | 362/106 |

*Primary Examiner*—Ira S. Lazarus
*Assistant Examiner*—Sue Hagarman
*Attorney, Agent, or Firm*—Leon Gilden

[57] ABSTRACT

A signal helmet for use by individuals of limited physical and sensory capacity, such as loss of vision and hearing, is provided to include a padded helmet shell formed with a strobe thereon. A modification of the invention includes translucent reflector blades rotatably mounted adjacent the strobe light to effect illumination to enhance strobe effect, wherein further use of the blades includes a plurality of mirror blades mounted coaxially and above the translucent blades to further enhance strobe effect for a signalling procedure.

2 Claims, 4 Drawing Sheets

SIGNAL HELMET APPARATUS

BACKGROUND OF THE INVENTION

1. Field of the Invention

The field of invention relates to signal apparatus, and more particularly pertains to a new and improved signal helmet apparatus arranged to provide for signalling relative to an individual requiring assistance.

2. Description of the Prior Art

Various signal structure is utilized in the prior art to provide for assistance to an individual requiring help. Particularly people of limited sensory capacity, such as loss of hearing and eye sight may require assistance and are taxed as to their ability to do so. The instance invention affords an organization to provide audible and visual signalling relative to that individual.

Prior art signal structure is typified in U.S. Pat. No. 3,963,917 to Romano setting forth an illumination safety helmet, wherein light structure is utilized mounted to a top surface of a helmet structure.

U.S. Pat. No. 4,186,429 to Johnston sets forth a further example of a flashing light structure mounted to a top surface of a helmet member.

U.S. Pat. No. 4,793,007 to Branett provides for a safety helmet mounting a light adjustably mounted to a forward end of the helmet surface.

U.S. Pat. No. 4,782,536 to Stricklin, et al. is a further example of a strobe light mounted to a top surface of a helmet member.

U.S. Pat. No. 4,901,210 to Hanabusa is a further example of a light member mounted to a helmet rearwardly thereof illustrating particular securement of the light structure relative to the helmet in use.

As such, it may be appreciated that there continues to be a need for a new and improved signal helmet apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of helmet apparatus now present in the prior art, the present invention provides a signal helmet apparatus wherein the same is arranged to provide for a strobe light to direct a signal, as well as a speaker member to provide for audible and visual signalling relative to a helmet structure. As such, the general purpose of the present invention, which will be described subsequently in greater detail, is to provide a new and improved signal helmet structure which has all the advantages of the prior art helmet apparatus and none of the disadvantages.

To attain this, the present invention provides a signal helmet for use by individuals of limited physical and sensory capacity, such as loss of vision and hearing, to include a padded helmet shell formed with a strobe thereon. A modification of the invention includes translucent reflector blades rotatably mounted adjacent the strobe light to effect illumination to enhance strobe effect, wherein further use of the blades includes a plurality of mirror blades mounted coaxially and above the transulcent blades to further enhance strobe effect for a signalling procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved signal helmet apparatus which has all the advantages of the prior art helmet apparatus and none of the disadvantages.

It is another object of the present invention to provide a new and improved signal helmet apparatus which may be easily and efficiently manufactured and marketed.

It is a further object of the present invention to provide a new and improved signal helmet apparatus which is of a durable and reliable construction.

An even further object of the present invention is to provide a new and improved signal helmet apparatus which is susceptible of a low cost of manufacture with regard to both materials and labor, and which accordingly is then susceptible of low prices of sale to the consuming public, thereby making such signal helmet apparatus economically available to the buying public.

Still yet another object of the present invention is to provide a new and improved signal helmet apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
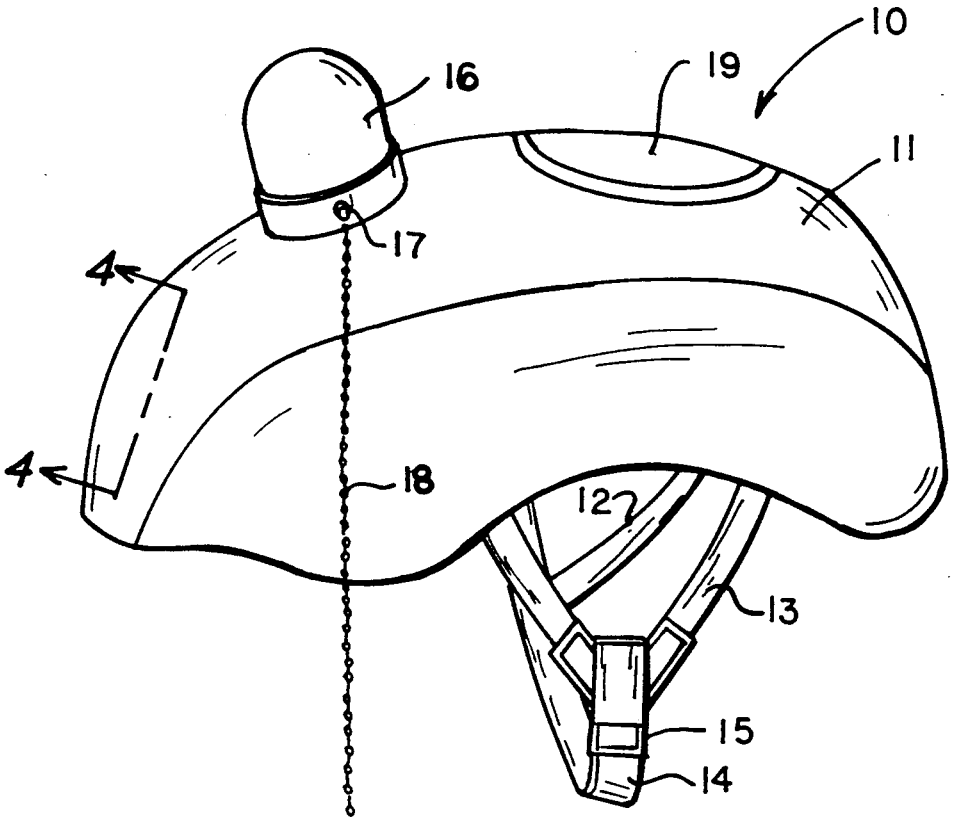
FIG. 1 is an isometric illustration of the instant invention.
Figure 2:
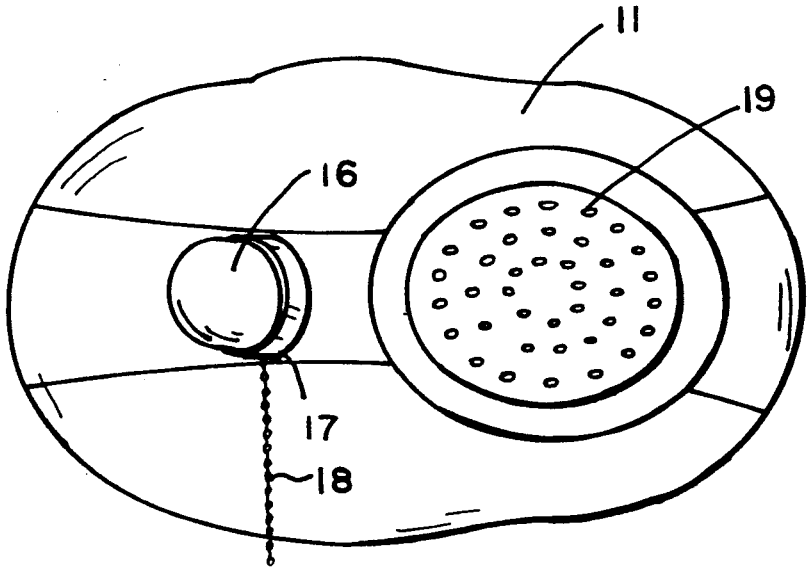
FIG. 2 is an orthographic top view of the instant invention.
Figure 3:
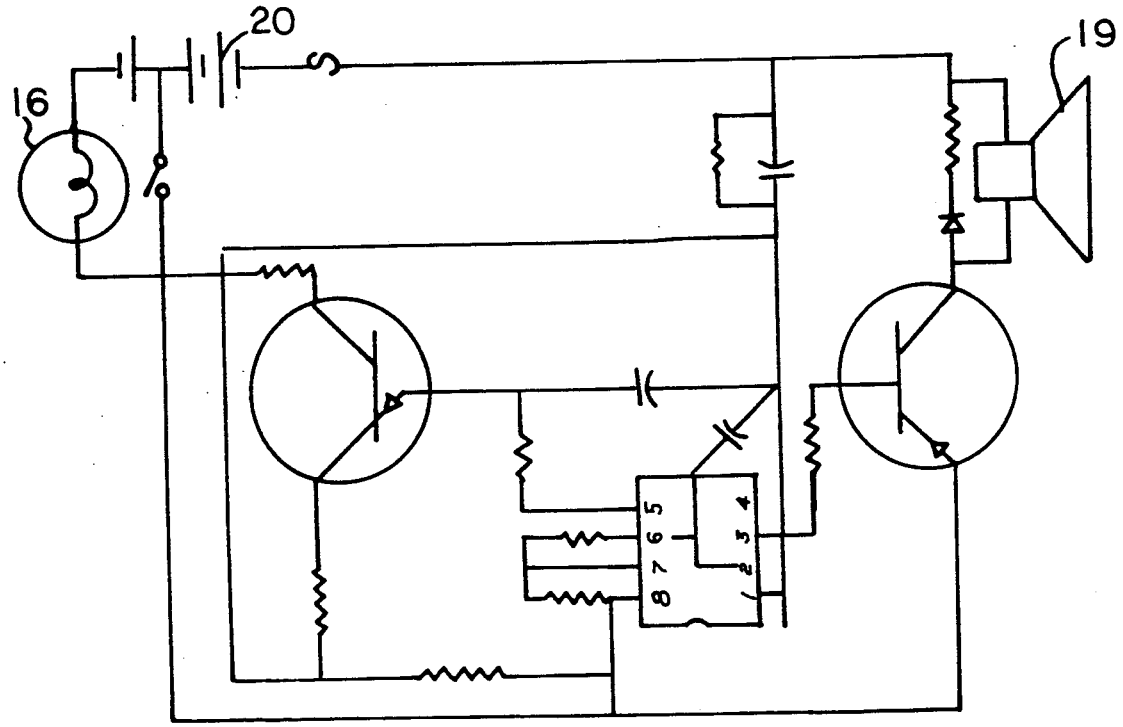
FIG. 3 is a diagrammatic illustration of a typical electrical circuit for use by an individual to provide for a strobing effect.
Figure 4:
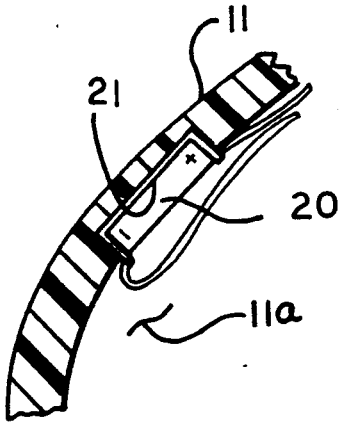
FIG. 4 is an orthographic view, taken along the lines 4—4 of FIG. 1 in the direction indicated by the arrows.
Figure 5:
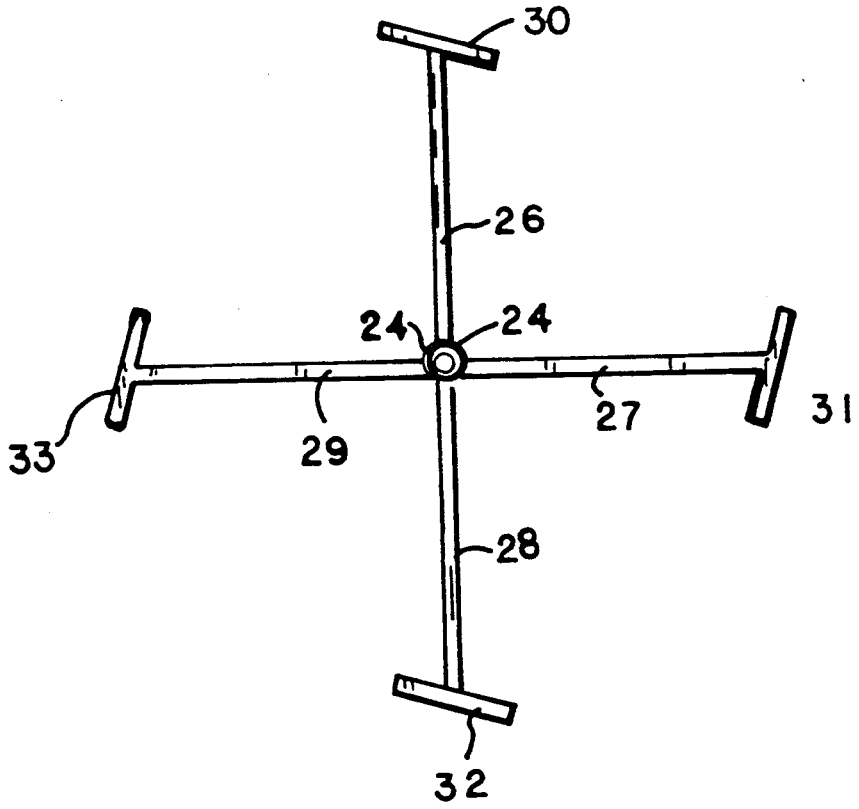
FIG. 5 is an orthographic top view of a translucent blade structure rotatably mounted to the top surface of the helmet.
Figure 6:
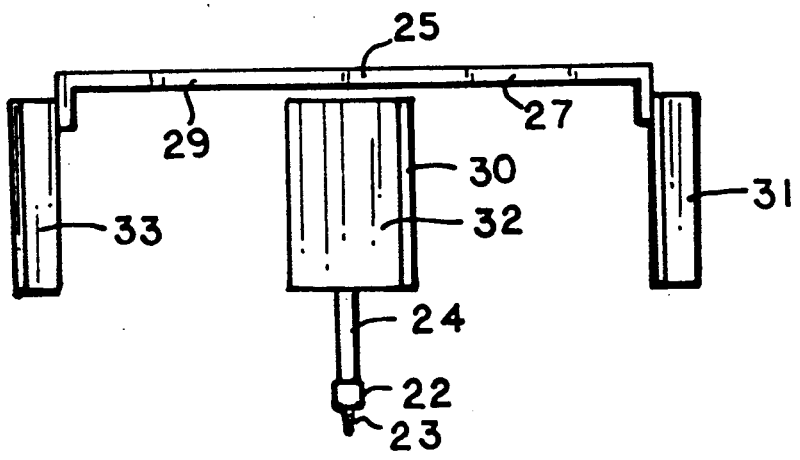
FIG. 6 is an orthographic side view of the blade structure, as illustrated in FIG. 5.
Figure 7:
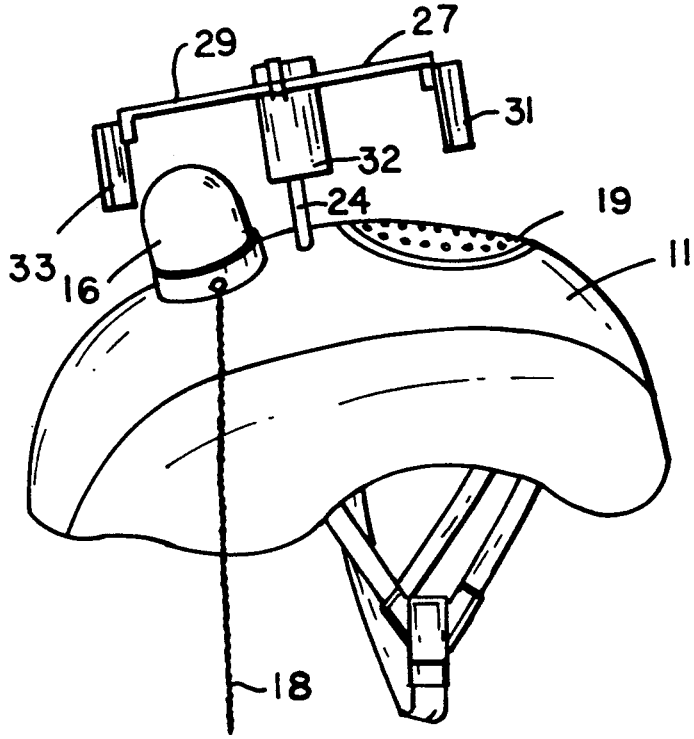
FIG. 7 is an isometric illustration of the reflector blades mounted to the helmet shell.
Figure 8:
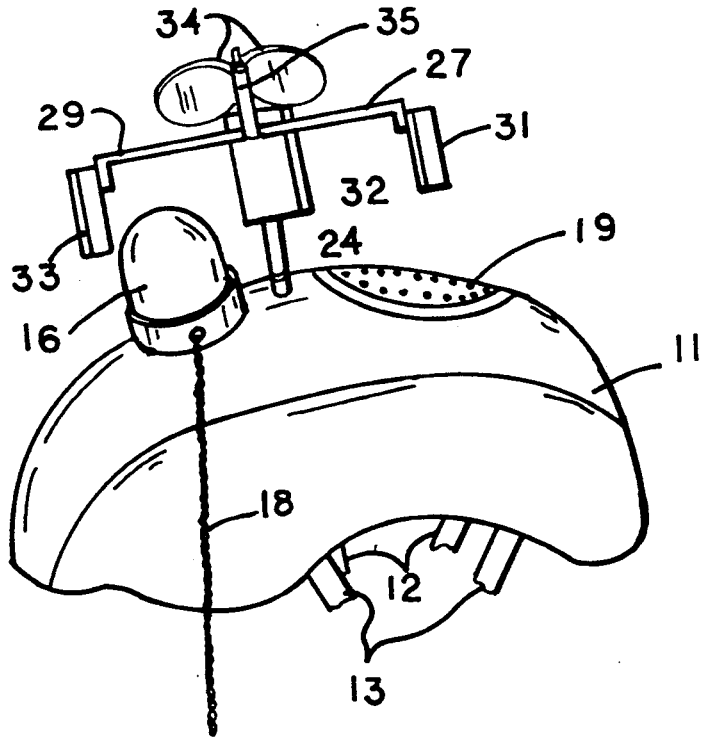
FIG. 8 is an isometric illustration of the reflector blades and mirror blades mounted to the helmet shell of the instant invention.

With reference now to the drawings, and in particular to FIGS. 1 to 8 thereof, a new and improved signal helmet apparatus embodying the principles and concepts of the present invention and generally designated by the reference numeral 10 will be described.

More specifically, the signal helmet apparatus 10 of the instant invention essentially comprises a padded helmet shell 11 defining a conical cavity 11*a* (see FIG. 4), and includes a continuous lower perimeter with respective right and left "V" shaped straps 12 and 13 extending downwardly from respective right and left sides of the lower perimeter, including a connecting adjustable chin strap 14 interconnecting the right and left "V" shaped straps 12 and 13 together, with a strap buckle 15 mounted to the chin strap 14 to provide for adjustment of the chin strap relative to an individual.

A strobe light 16 is mounted medially of a top surface of the helmet shell 11, including an on/off switch mounted to the strobe light 16 to effect selective actuation of the strobe light and an associated speaker 19 to effect an audible alarm in combination with the strobe light. The on/off switch is actuated by pull chain 18 that is mounted to the on/off switch to dangle and project beyond the lower perimeter edge of the helmet shell 11. The dangling of the switch permits an individual of limited sight and auditory capacity to feel for the pull chain to effect selective closure of the switch to effect actuation of the strobe light 16 and the speaker 19. A battery 20 is mounted within a recess battery cavity 21 within the helmet structure to permit for its convenient replacement for effecting powering of the light and speaker assembly utilized by the invention.

A support socket 22 including a socket fastener 23 is mounted adjacent to the strobe light 16, with a rotatably shaft 24 rotatably mounted within the support socket 22. The rotatable shaft includes a respective first, second, third, and fourth radial leg 26, 27, 28, and 29 respectively oriented orthogonally relative to the rotatably shaft 24, with the radial legs equally spaced relative to one another, with the first through fourth radial legs 26–29 including respective first through fourth translucent blades defined by respective first, second, third, and fourth translucent blades 30, 31, 32, and 33 mounted at the outer distal end of each radial leg, with each translucent blade oriented in a parallel relationship relative to the shaft 24. The translucent blades are formed of contrasting colorations and enhance strobe light effect as they rotate about the strobe light 16, wherein the strobe light 16 is positioned within the cylinder of revolution defined by the translucent blades 30–33 as they rotate. The translucent blades are oriented for rotation by prevailing air currents about the helmet shell 11. Further, a shaft support mount 25 mounted at an upper terminal end of the rotatable shaft 24 mounting the radial legs also mounts a mirror blade shaft 35 projecting above the rotatable shaft 24 coaxially aligned therewith, with the mirror blades 34 spaced about the shaft 35, with the mirrors enhancing reflection of available lighting directed by the strobe light 16 to further enhance visual impact of the helmet apparatus in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A signal helmet apparatus, comprising, a padded helmet shell, the padded helmet shell defines a concave cavity with an exterior surface and a lower perimeter edge, the lower perimeter edge includes a plurality of strap members mounted to opposed sides of the perimeter edge, wherein the strap members include an adjustable chin strap securing the strap members together for securement of the strap members and the chin strap about an individual, and the exterior surface including a strobe light mounted to the exterior surface, wherein the strobe light includes a strobe light switch and a pull chain mounted to the switch to effect selective actuation of the switch, wherein the pull chain extends along the exterior surface and extends below the perimeter edge to permit ease of manual sensory feel and grasping of the pull chain, and the helmet shell further includes an audible speaker member mounted within the shell for simultaneous actuation of the speaker and strobe light, wherein the speaker includes an audible means for projecting an audible signal through the speaker member, and a battery mounted within the helmet shell, including a battery cavity directed into the helmet shell from the concave cavity, with the battery in electrical communication between the strobe light and the speaker, and a support socket mounted to the exterior surface adjacent the strobe light, the support socket including a rotatable shaft mounted within the support socket, wherein the rotatable shaft extends upwardly relative to the exterior surface, and includes a plurality of radial legs orthogonally mounted to an upper terminal end of the rotatable shaft, each radial leg includes an outer distal end, and each outer distal end includes a translucent blade member fixedly mounted to each outer distal end, wherein each translucent blade and each radial leg are equally spaced relative to one another about the rotatable shaft, wherein the rotatable shaft is arranged for rotation relative to the support socket, and wherein the translucent blades define a cylinder of revolution containing the strobe light therewithin.

2. An apparatus as set forth in claim 1 including a mirror blade shaft extending upwardly of the radial legs and coaxially aligned with the rotatable shaft and fixedly mounted to the rotatable shaft, wherein the mirror blade shaft includes a plurality of mirror blades equally spaced about the mirror blade shaft, wherein the mirror blades each include mirrored side surfaces to enhance light reflection, wherein the mirror blades extend above the strobe light.

* * * * *